US005343226A

United States Patent [19]

Niedermeyeyr et al.

[11] Patent Number: 5,343,226

[45] Date of Patent: Aug. 30, 1994

[54] INK JET INK SUPPLY APPARATUS

[75] Inventors: John F. Niedermeyer, Sandy Hook, Conn.; Viacheslav B. Maltsev, Stormville, N.Y.; Robert L. Rogers, Sandy Hook, Conn.

[73] Assignee: Dataproducts Corporation, Woodland Hills, Calif.

[21] Appl. No.: 590,169

[22] Filed: Sep. 28, 1990

[51] Int. Cl.[5] ..... B41J 2/175

[52] U.S. Cl. ..... 347/85

[58] Field of Search ..... 346/140 R, 75; 417/474, 417/475, 476, 477

[56] References Cited

U.S. PATENT DOCUMENTS

| | | | |
|---|---|---|---|
| 3,930,761 | 1/1976 | Barraclough | 417/476 |
| 4,123,761 | 10/1978 | Kimura et al. | 346/140 R |
| 4,162,501 | 7/1979 | Mitchell et al. | 346/140 R |
| 4,183,031 | 1/1980 | Kyser et al. | 346/140 R |
| 4,333,088 | 6/1982 | Diggins | 346/140 R |
| 4,359,744 | 11/1982 | Salmre | 346/140 R |
| 4,376,283 | 3/1983 | Bower | 346/140 R |
| 4,593,294 | 6/1986 | Parisi | 346/140 R |
| 4,700,202 | 10/1987 | Kuranishi et al. | 346/140 R |

FOREIGN PATENT DOCUMENTS

| | | | |
|---|---|---|---|
| 0003959 | 1/1988 | Japan | 346/140 R |

*Primary Examiner*—Benjamin R. Fuller
*Assistant Examiner*—Alrick Bobb
*Attorney, Agent, or Firm*—Woodcock Washburn Kurtz Mackiewicz & Norris

[57] ABSTRACT

An ink supply apparatus comprises a container for storing ink jet ink having an opening for releasing ink from the container and a valve member mounted in the opening in the container and spring means coupled to the valve member for biasing the valve member so as to prevent the flow of ink from the container when the ink supply is not mounted on a supply base.

4 Claims, 3 Drawing Sheets

INK JET INK SUPPLY APPARATUS

BACKGROUND OF THE INVENTION

This invention relates to impulse ink jet devices and ink supply systems for such devices.

Impulse ink jet devices which provide a drop on demand in response to the state of energization of a transducer are typically supplied with ink from relatively small cartridges since the volume of ink consumed in an impulse ink jet device is relatively small as a normal rule. However, certain industrial applications of impulse ink jet devices require large volumes of ink over extended periods of time. For example, on-line printing of corrugated containers may require a plurality of ink jet print heads where each head comprises a large number of jets so as to produce relatively large characters and/or bar codes. Under these circumstances, a large volume of ink is used for extended periods of time. The use of small cartridges becomes impractical. For printing in this type of application, a relatively large ink supply is necessary, e.g., a container holding 125, 250, 500 or 1000 milliliter. The use of such a large ink supply does however pose certain problems for an impulse ink jet apparatus.

First, an impulse ink jet apparatus must be primed properly with ink in order to operate properly. Priming of an impulse ink jet requires that positive pressure be generated in connection with the supply of ink so as to force the ink through the ink jet chambers and the orifices of the ink jet while preventing the sucking of ink back through the orifices and the chambers upon completion of priming. One possibility for priming involves a bottle squeezing technique with some relief of the built-up pressure through the use of various types of valves including umbrella, duck bill and flapper valves. Such valves are required to be sensitive to back pressure while being strong enough to seal ink during the squeezing phase. In addition, such valves may present problems of material compatibility with the inks used. Accordingly, it may be difficult to reliably design to meet the above-stated criteria. Another possibility includes a manually operated valve but this requires precisely timed manual procedures which may pose difficulties to operators in the field.

Priming of an impulse ink jet system may also be accomplished by pressurizing an air space above an ink reservoir. However, any increase in ink pressure in a container in which the ink reservoir is located will continue to force ink out through the ink jet device even after the pressure is removed. The device may therefore "weep" uncontrollably. Pressure could be applied directly to the container by puncturing a hole in the container in the air space above the ink which may also be used so as to relieve pressure within the container as soon as the pressure is removed from the container. This option, however, makes removal of partially filled containers messy as well as foreclosing on ecologically sound refilling policy.

Peristaltic pumps have been proposed for use in priming impulse ink jet apparatus wherein rollers are moved into contact with a tube containing ink, rolled along the tube containing ink and then separated from the tube so as to allow the free flow of ink through the tube. Such a mechanism is complex, expensive and may be difficult to implement in a variety of applications.

SUMMARY OF THE INVENTION

It is an object of this invention to provide a large ink supply for an impulse ink jet device.

It is a further object of this invention to provide a priming mechanism for a large ink supply used in an impulse jet system which is reliable, easy to use and poses no material compatibility problems.

It is a further object of this invention to provide an ink supply system and an associated priming mechanism which is ecologically sound.

It is a still further object of this invention to provide an ink supply and associated priming mechanism which does not cause weeping from the head at the conclusion of priming.

It is a still further object of this invention to provide an ink supply and associated priming mechanism which substantially eliminates the possibility of any spillage of ink.

It is a still further object of this invention to provide a priming mechanism which imposes the minimum of constraints on the remainder of the system.

In accordance with these and other objects of the invention, a preferred embodiment of the invention comprises an impulse ink jet apparatus including an impulse ink jet head, a supply base comprising a reservoir for ink and adapted to receive an ink supply and means for coupling the ink jet head to the supply base.

In accordance with one important aspect of the invention, means for coupling the impulse ink jet head to the supply base includes a flexible tube which is coupled to a hand actuated peristaltic pumping device comprising a support surface in contact with and supporting the tube, a squeezing surface adapted to contact and squeeze the tube against the support surface and means for moving the squeezing surface relative to the support surface through a peristaltic pumping orbit. The orbit includes movement from a static position in the absence of a hand gripping force with no contact between the squeezing surface and the support surface to a position of contact between the squeezing surface and the tube in the presence of a hand gripping force. Such movement is followed by movement between the support surface and the squeezing surface in one direction while the squeezing surface is in contact with the tube during continued application of the hand gripping force so as to force ink through the tube in a peristaltic pumping stroke followed by movement between the support surface and a squeezing surface in the return stroke so as to return the squeezing surface to the static position in the absence of a hand gripping force with no contact between the squeezing surface and the tube. The squeezing surface comprises a roller and the support surface is arcuate with the angle of attack between the squeezing surface and the support surface being not more than 45°.

In accordance with another important aspect of the invention, the ink supply comprises a container for storing ink jet ink having an opening for releasing ink from the container and a valve member mounted in the opening in the container and spring means coupled to the valve member for biasing the valve member so as to prevent the flow of ink from the container when the ink supply is not mounted on the supply base.

In a preferred embodiment of the invention, the container comprises a bottle portion, a cap portion and a valve enclosure located within the cap portion for enclosing the spring means and a portion of the valve member. Preferably, the cap portion includes threads and the bottle portion includes threads which are mutually engaged. The actuating surface of the valve means is exposed through the opening of the container and is preferably concave so as to receive actuating means mounted on the supply base.

DETAILED DESCRIPTION OF THE PREFERRED EMBODIMENT

Figures 1, 2:
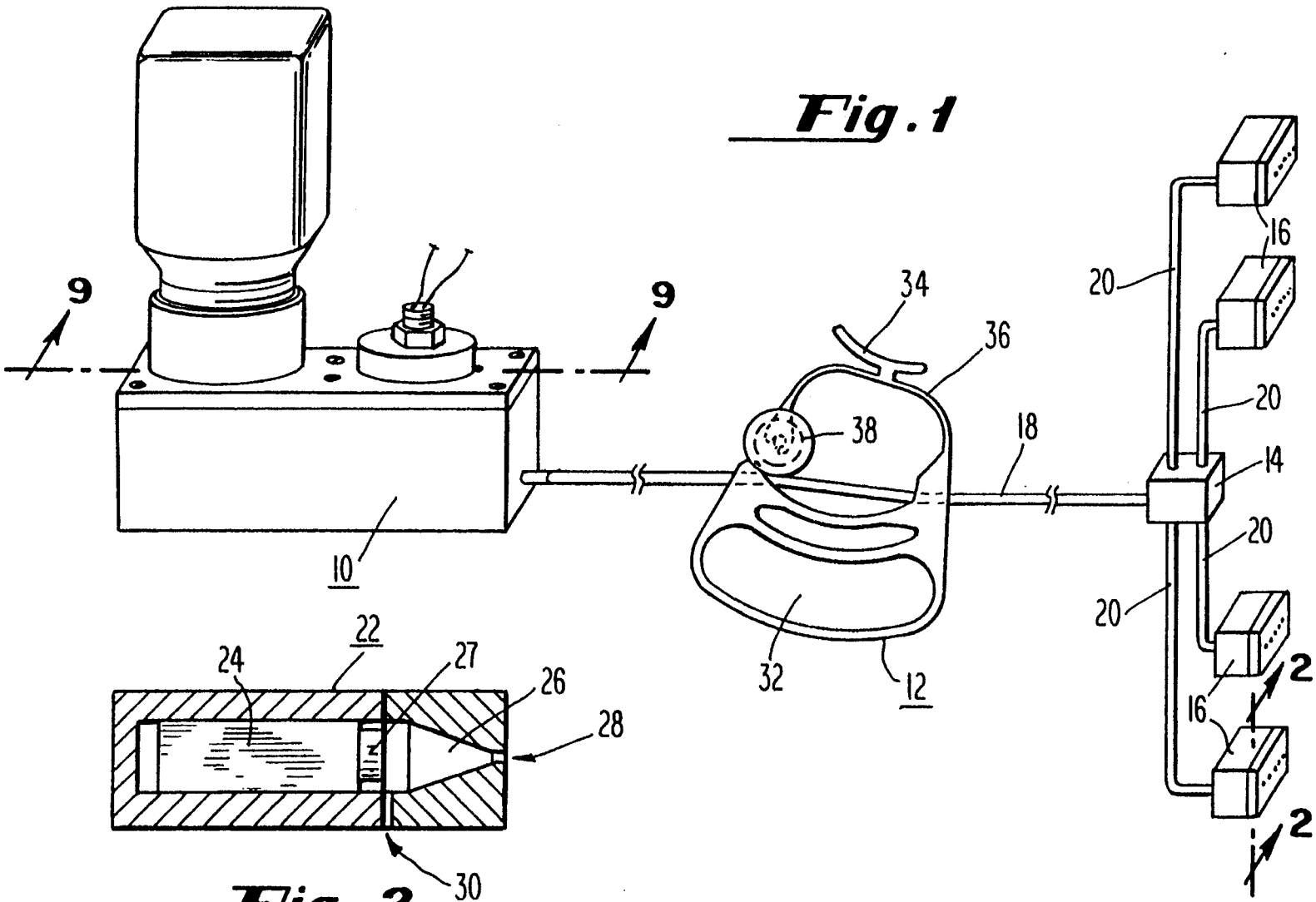
FIG. 1 is a view of a ink jet apparatus.
FIG. 2 is a sectional view through one of the ink jet heads of FIG. 1 taken along the line 2—2.

Referring to FIG. 1, an ink supply system is shown comprising a reservoir 10, a peristaltic pumping apparatus 12, a manifold 14 and a plurality of impulse ink jets 16. The reservoir 10 is coupled to the manifold 14 by a flexible tube 18 which is coupled to the peristaltic pumping apparatus 12. Flexible tubes 20 couple the manifold to the various heads 16. Each of the heads 16 comprises a plurality of impulse ink jet devices 22 as shown in FIG. 2. The devices 22 are made in accordance with the disclosure of U.S. Pat. No. 4,459,60 which are incorporated herein by reference. A transducer 24 is coupled to an ink jet chamber 26 through a foot 27 having an orifice 28 for the ejection of droplets and an input opening 30 to which ink is supplied from the tubes 20 coupled to the manifold 14. Droplets are ejected on demand in response to the state of energization of the transducer 24 of the control of an electronic system. It will be appreciated that each of the heads 16 must be actually positioned above the uppermost level of ink in the reservoir 10 so as to avoid placing the ink under any sort of pressure head which would cause weeping from the orifices 28.

Figure 4:
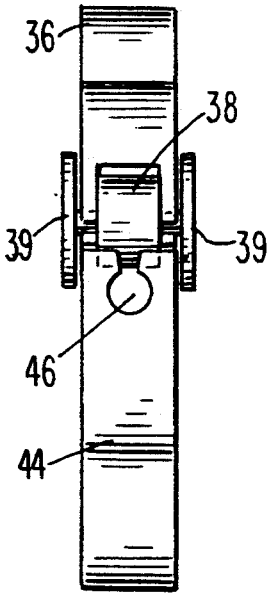
FIG. 4 is an end view of the peristaltic pumping apparatus of FIG. 3.
Figure 3:
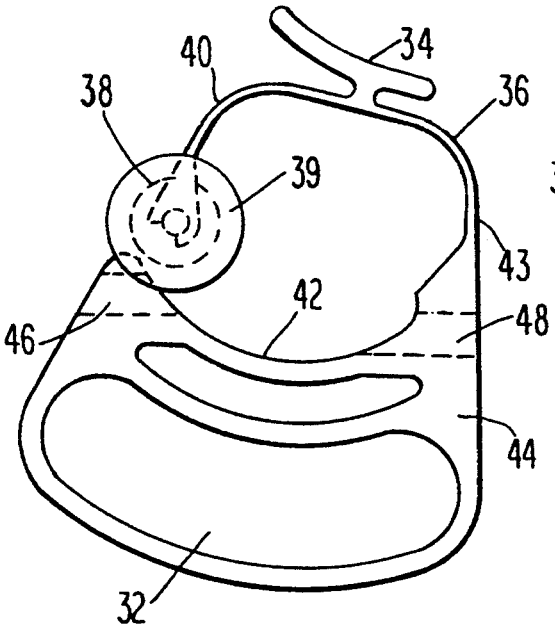
FIG. 3 is a plan view of the hand gripped peristaltic pumping apparatus shown in FIG. 1.
Figure 5:
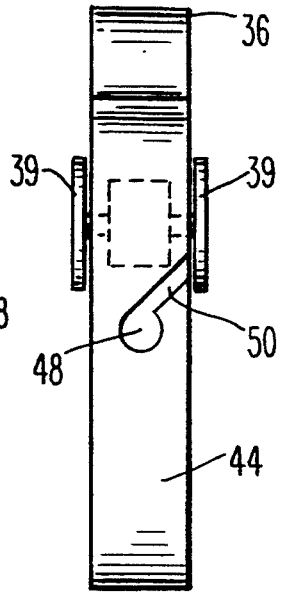
FIG. 5 is another end view of the peristaltic pumping apparatus shown in FIG. 3.

In accordance with one important aspect of the invention, a peristaltic pumping apparatus 12 is adapted to be gripped by hand with fingers being inserted through the elongated opening 32 and a pedestal 34 engaged by the palm or the base of the thumb. As also shown in FIGS. 3 through 5, the apparatus 12 comprises the U-shaped structure 36 carrying a squeezing surface in the form of a roller 38 including caps 39 which is snapped into place at the end of one spring arm 40 and a support surface 42 which extends from a position adjacent the roller 38 to another spring arm 43 which is integrally formed with a base 44 in which the finger opening 32 is located. As shown in FIG. 4, the base 44 includes an opening 46 through which the flexible tube 18 may extend when in contact with the support surface 42, and the base 44 also includes an opening 48 as shown in FIG. 5 including a lead-in 50 through which the tube 18 as shown in FIG. 1 may extend.

When the peristaltic pumping apparatus of FIGS. 3 through 5 is actuated by application of hand pressure as described above, the squeezing surface on the roller 38 moves through a peristaltic pumping orbit so as to force ink through the flexible tube during a peristaltic pumping stroke when the pressure of the hand is removed so as to prevent sucking ink back through the tube 18 and the ink jet print head 16 shown in FIG. 1. The peristaltic pumping orbit may best be appreciated by reference to FIGS. 6 through 8 which will now be described in detail.

Figure 6:
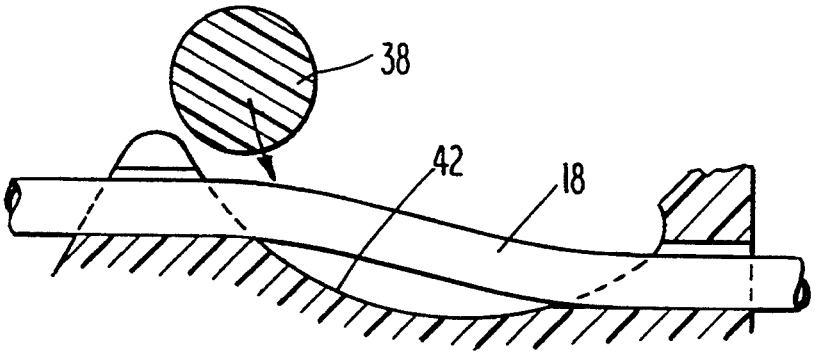
FIGS. 6 through 8 are schematic views of the peristaltic pumping apparatus shown in FIGS. 3-5 in various positions.
Figure 7:
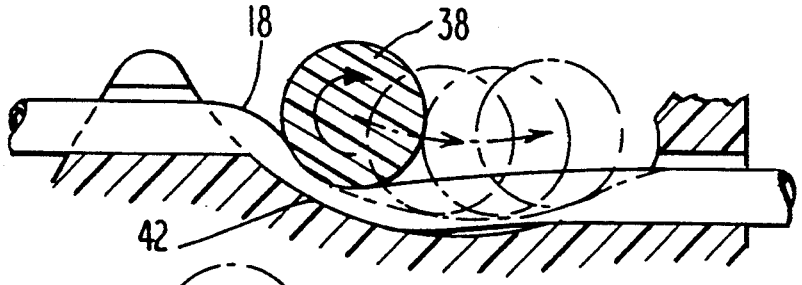
Figure 8:
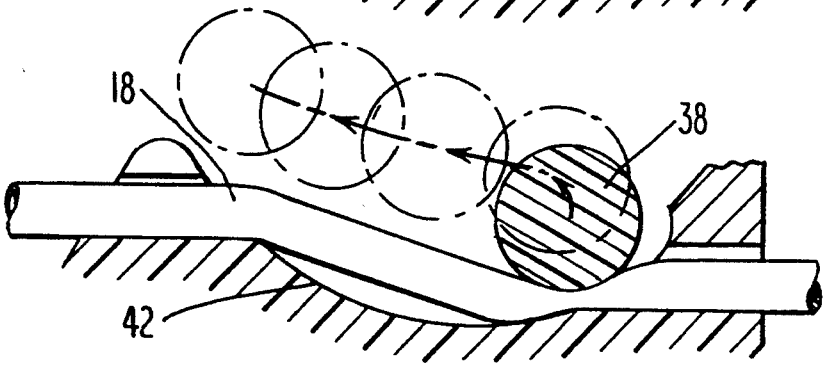

As shown in FIG. 6, the roller 38 is in the static position, i.e., before application of any hand pressure, and spaced from the tube 18. As shown in FIG. 7, the roller 38 is moved along the tube 18 which is pressed against the support surface 42 and pressure is applied through the tube 18. The movement depicted in FIG. 7 is the peristaltic pumping stroke. At the conclusion of the peristaltic pumping stroke as shown in FIG. 8, the hand pressure is released and the roller 38 is automatically lifted off the tube 18 so as to permit the tube 18 to return to the decompressed position and the roller 38 is automatically moved back to the static position shown in FIG. 6. The movement of the roller 38 through the peristaltic pumping orbit is achieved by the spring arms 40 and 43. During the application of hand pressure to the apparatus 12, the spring 40 permits the roller 38 to advance along the surface 42 at an attack angle of no more than 45°. As the peristaltic pumping action proceeds as a result of the continued application of pressure as shown in FIG. 7, the spring arm 43 is biased to the point that upon release of the hand pressure, the roller moves away from the tube 18 as shown in FIG. 8 and returns to the static position as shown in FIG. 6. It has been found that the peristaltic pumping apparatus 12 may be integrally formed from a variety of plastic materials to provide the appropriate characteristic including the necessary resilience for the springs 40 and 43. However, Nylon 6/6 is especially preferred.

Figure 9:
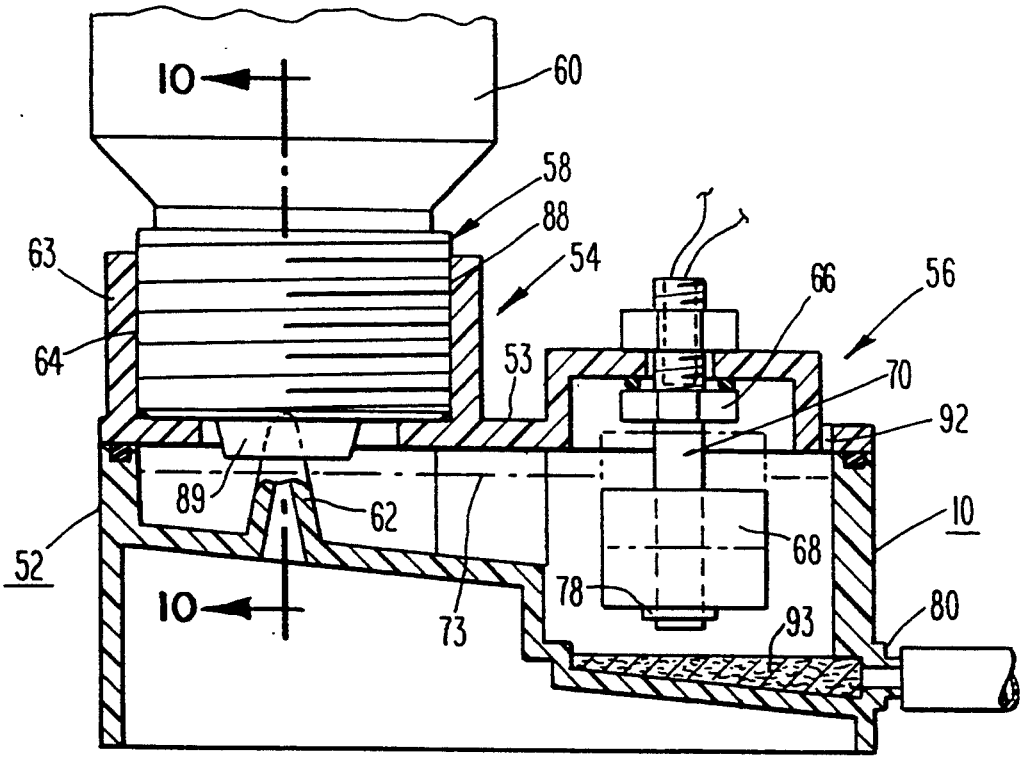
FIG. 9 is a sectional view of the ink reservoir and supply of FIG. 1 taken along line 9—9.
Figure 10:
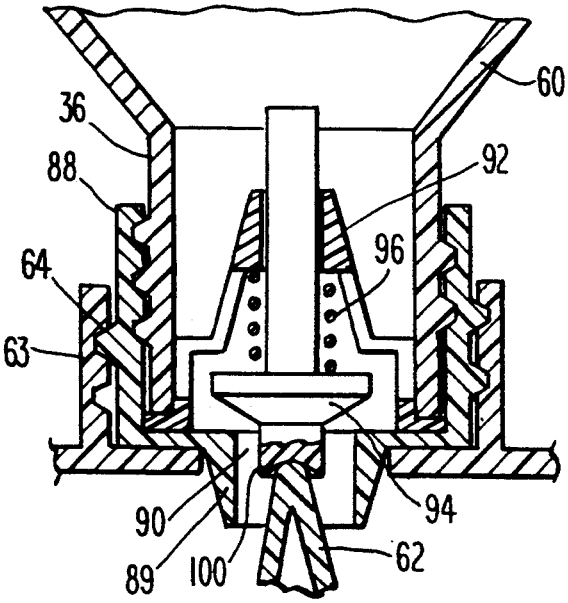
FIG. 10 is an enlarged sectional view of the ink supply mounted on the reservoir base as shown in FIG. 1.

In accordance with another important aspect of the invention, the ink reservoir 10 permits a relatively large supply of ink to be used while facilitating the priming in an efficient, ecologically sound and easy manner. More particularly, as best shown in FIG. 9, the reservoir 10 includes an ink supply base 52 including a cover 53 having a container support portion 54 and a level detect portion 56. The container support portion includes an opening 58 in the cover 53 which extends upwardly and is adapted to receive an ink supply apparatus including a container 60 shown in FIG. 9. A valve actuating means in the form of a projection 62 is located immediately below the opening 58 which is adapted to open the valve associated with the container 60 shown in FIG. 9 which will be described in more detail subsequently. The opening 58 is located in a neck 63 which extends upwardly from the cover 53 and includes threads 64 for receiving the ink supply as best shown in FIGS. 9 and 10.

The level detect portion 56 in the cover 53 includes a level detect mechanism 66 which is mounted on the cover 53. As shown, the mechanism 66 includes a float 68 which is free to move along the shaft 70, to the portion shown in phantom and a magnet 72 located in an internal opening of the float 68 which actuates a proximity switch so as to signal the level 73 of the ink within the reservoir formed by the base 52. The signal wires 76 are coupled to the proximity switch as shown. A washer 78 holds the float 68 on the shaft 70. A level detect device of this type is sold by Signal Systems International under the tradename FS2-B Liquid Level Switch.

A port 80 in the base 52 is provided which may be coupled to the tube 18 as shown in FIG. 1. The port 80 may actually be located in a separate fitting. A vent opening 92 is also provided in the top of the cover 53 as shown or may be provided elsewhere. A filter 93 is shown in base 52 adjacent the fitting 80.

Figure 11:
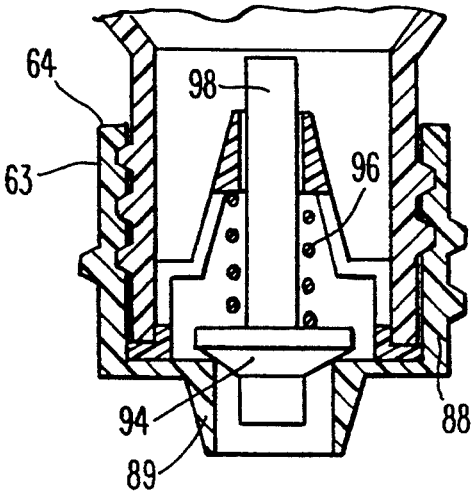
FIG. 11 is an enlarged sectional view of the ink supply prior to mounting on the reservoir base.

In accordance with another important aspect of the invention, a replaceable ink supply which is mounted on the cover 53 comprises a valve mechanism which interrupts gravity feed of ink into the base 52. This will now be discussed in detail with respect to FIGS. 10 and 11. As shown, the ink supply comprises the container 60 having a neck 86 which is engaged by the threaded cap 88 terminated in a projection 89 having an opening 90 adapted to be aligned with the actuating member 62 in the base 52. The projection 89 extends into the reservoir 10. A valve enclosure 92 is inserted into the neck 86 of the container 60 so as to enclose a plunger or valve member 94 in conjunction with the cap 88. As shown in FIG. 11, the plunger member 94 is biased closed by the spring 96 which encircles a shaft 98 of the plunger member 94. However, as shown in FIG. 10, the plunger member 94 is opened or unseated from the cap 88 by contact between the valve actuating member 62 and a concave actuating surface 100 of the plunger member 94. In this manner, ink from the container 60 is permitted to flow upon mounting of the container 60 on the base 52 of the reservoir without any extra steps on the part of the operator and without any leakage from the container 60. It will also be appreciated that the container 60 may be readily refilled after removal from the base 52 by simply depressing plunger member 94 thereby providing an ecologically sound supply system.

It will be appreciated that the manifold 14 is optional and a single head 16 may be used with the peristaltic pumping apparatus 12. It will also be appreciated that the manifold 14 may be used with a plurality of peristaltic pumping apparatus 14, one for each tube 20.

Although a particular embodiment of the invention has been shown and described, it will be appreciated that other modifications and embodiments will occur to those of ordinary skill in art which will fall within the true spirit and scope of the appended claims.

We claim:

1. An impulse ink jet system, comprising:

an impulse ink jet head;

a supply base comprising a reservoir for ink having an opening facing upwardly, base coupling means for connecting a supply of ink to said supply base and a valve actuating means for controlling the flow of ink by said supply base;

means for coupling said impulse ink jet head to said supply base; and an ink supply apparatus comprising a container for storing ink jet ink having a container opening juxtaposed to the opening of said supply base for releasing ink and a container coupling means adapted to engage said base coupling means when said container is mounted above said supply base;

a valve member mounted in the container opening, spring means coupled to the valve member for biasing the valve member closed so as to prevent ink flow from the container when the supply apparatus is not mounted on the ink jet system; and a valve actuating surface connected to said valve member and exposed through said container opening, said actuating surface engaging said valve actuating means when the supply apparatus is mounted on said supply base for opening said valve so as to permit the flow of ink from said container opening into said reservoir when said actuating surface is engaged, wherein said container includes a projection extending into said reservoir with said container opening extending therethrough.

2. Ink jet supply apparatus for use in an impulse ink jet system, comprising:

a container for storing ink jet ink having an opening for releasing ink from the container;

a valve member mounted at the opening within the container;

a spring means coupled to the valve member for biasing the valve member closed so as to prevent the flow of ink from the container when the apparatus is not mounted in the ink jet system; and a valve member actuating surface coupled to said valve member and juxtaposed to said opening, said actuating surface engaging the ink jet system when the supply apparatus is mounted in said ink jet system for opening said valve member so as to permit the flow of ink from said opening when said actuating surface is engaged, wherein said container comprises a bottle portion, a cap portion and a valve enclosure located within said cap juxtaposed to said opening, said spring means and said valve member being located within said valve enclosure.

3. Ink jet supply apparatus for use in an impulse ink jet system, comprising:

a container for storing ink jet ink having an opening for releasing ink from the container;

a valve member mounted at the opening within the container;

a spring means coupled to the valve member for biasing the valve member closed so as to prevent the flow of ink from the container when the apparatus is not mounted in the ink jet system;

a valve member actuating surface coupled to said valve member and juxtaposed to said opening, said actuating surface engaging the ink jet system when the supply apparatus is mounted in said ink jet system for opening said valve member so as to permit the flow of ink from said opening when said actuating surface is engaged; and a cap having a threaded periphery mounted on said container and exposing said valve member actuating surface through said opening.

4. Ink jet supply apparatus for use in an impulse ink jet system, comprising:

a container for storing ink jet ink having an opening for releasing ink from the container;

a valve member mounted at the opening within the container;

a spring means coupled to the valve member for biasing the valve member closed so as to prevent the flow of ink from the container when the apparatus is not mounted in the ink jet system; and a valve member actuating surface coupled to said valve member and juxtaposed to said opening, said actuating surface engaging the ink jet system when the supply apparatus is mounted in said ink jet system for opening said valve member so as to permit the flow of ink from opening when said actuating surface is engaged, wherein said container includes a projection adapted to extend into said ink jet system.

* * * * *

UNITED STATES PATENT AND TRADEMARK OFFICE

CERTIFICATE OF CORRECTION

PATENT NO : 5,643,226

DATED : July 1, 1997

INVENTOR(S) : Delos M. Cosgrove, et al.

It is certified that error appears in the above-identified patent and that said Letters Patent is hereby corrected as shown below:

IN THE CLAIMS:

Column 6, line 4, change "4" to --5--.

Signed and Sealed this

Seventh Day of April, 1998

Bruce Lehman

*Attest:*

BRUCE LEHMAN

*Attesting Officer*

*Commissioner of Patents and Trademarks*